United States Patent [19]

Ludecke

[11] 4,380,149

Best Available Copy

[45] Apr. 19, 1983

[54] METHOD AND MEANS FOR DIESEL EXHAUST PARTICULATE EMISSION CONTROL

[75] Inventor: Otto A. Ludecke, Rochester, Mich.

[73] Assignee: General Motors Corporation, Detroit, Mich.

[21] Appl. No.: 232,320

[22] Filed: Feb. 9, 1981

[51] Int. Cl.[3] ..... F01N 3/18

[52] U.S. Cl. ..... 60/274; 60/284; 60/286; 60/294; 60/303

[58] Field of Search ..... 60/294, 286, 284, 303, 60/274

[56] References Cited

U.S. PATENT DOCUMENTS

| | | | |
|---|---|---|---|
| 3,451,213 | 6/1969 | Lang | 60/294 |
| 3,937,015 | 2/1976 | Akado | 60/294 |
| 4,054,108 | 10/1977 | Gill . | |
| 4,211,075 | 7/1980 | Ludecke | 60/303 |

*Primary Examiner*—Douglas Hart

*Attorney, Agent, or Firm*—Robert J. Outland

[57] ABSTRACT

A method and means for controlling diesel particulate emissions involves providing an exhaust trap filter to collect exhaust particulates at a point near the engine exhaust ports and providing means to periodically vent burning combustion chamber gases to the exhaust filter to initiate combustion and incineration of the collected particulates. Various means for conducting burning mixture to ignite the particulates in the filter are disclosed.

5 Claims, 1 Drawing Figure

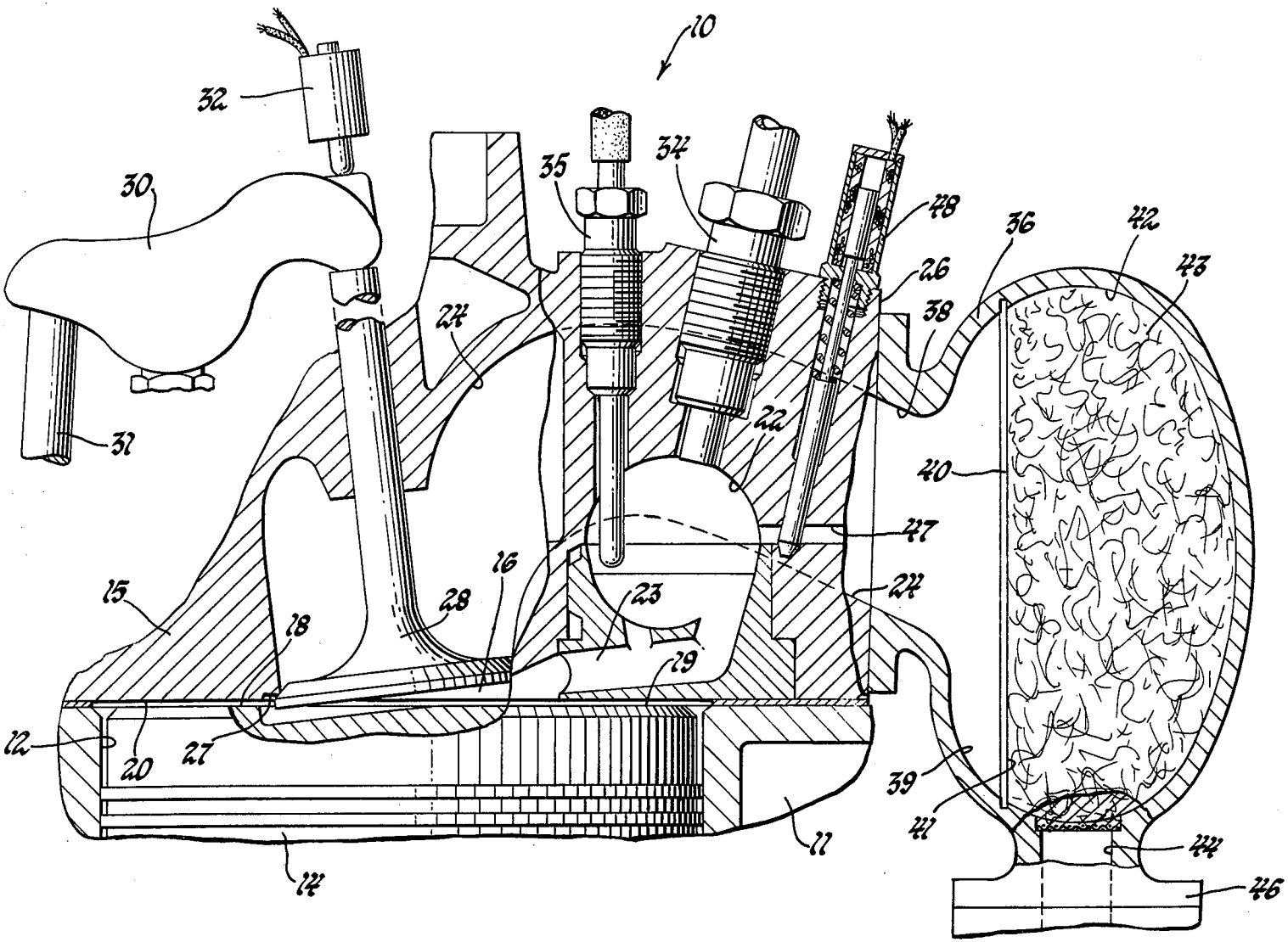
10
12
14
15
16
17
18
19
20
22
23
24
26
27
28
29
30
31
32
34
35
36
38
39
40
41
42
43
44
46
48

METHOD AND MEANS FOR DIESEL EXHAUST PARTICULATE EMISSION CONTROL

TECHNICAL FIELD

This invention relates to diesel engines and more particularly to a method and means for exhaust particulate control including collection of particulates in an exhaust trap and periodic incineration of the collected particulates.

BACKGROUND

It has been proposed in the art relating to diesel engines to obtain particulate emission control by the provision of an exhaust trap or filter in which particulates are collected with periodic incineration of the collected particulates. Various means have been proposed for igniting particulates collected in a trap at periodic intervals in order to obtain their incineration at desired intervals. Examples of such means include fuel burners incorporated in or ahead of the particulate trap, electric heating devices and throttling of the engine intake to increase the exhaust gas temperature. In general, such arrangements have required one or more additional heating units and/or relatively complex control systems to be added to the engine system.

SUMMARY OF THE INVENTION

The present invention utilizes an already existing engine combustion chamber or a plurality of them as a source of burning fuel-air mixture for use in heating and igniting particulates collected in an emission controlling exhaust particulate trap filter.

The method of the invention involves conducting, during the burning period of one or more of the engine combustion chambers, a portion of the burning gases directly to the particulate filter to heat and ignite the particulates collected therein. Various means are suggested for carrying out the method.

In a conventional precombustion chamber type diesel engine, one arrangement involves provision of an auxiliary conduit or passage from the precombustion chamber to an exhaust particulate filter contained within an adjacent engine exhaust manifold. An auxiliary control valve is arranged to selectively open the auxiliary passage after combustion begins in the prechamber to vent a part of the burning mixture into the exhaust filter to ignite the particulates.

Another arrangement includes the provision of an auxiliary vent passage directly from the main chamber of a direct injection or prechamber type engine to an adjacent exhaust particulate filter.

Still another involves auxiliary means for opening a conventional cylinder exhaust valve for a time during its cylinder combustion period to allow some of the burning mixture to escape through the normal exhaust passage directly to an adjacent particulate filter.

These and other embodiments, features and advantages of the invention will be more fully understood from the following description of a preferred embodiment taken together with the accompanying drawing.

BRIEF DESCRIPTION OF THE DRAWING

The single drawing FIGURE shows a fragmentary cross-sectional view through one of the cylinders of a diesel engine having exhaust particulate emission control means in accordance with the invention.

BEST MODE DISCLOSURE

Referring now to the drawing in detail, numeral 10 generally indicates a diesel engine of the automotive type. Engine 10 includes a cylinder block 11 defining a plurality of cylinders 12, only one of which is shown. Within each of the cylinders there is reciprocably movable a piston 14. The upper ends of each of the cylinders, as shown in the drawing, are closed by a cylinder head 15 which, together with each cylinder and its respective piston, defines a combustion chamber 16 at each cylinder closed end.

As is conventional with diesel engines of the prechamber type, the combustion chamber 16 includes a main chamber portion 18 that comprises the variable volume space between the upper end 19 of the piston and the lower surface 20 of the cylinder head. The combustion chamber 16 also includes a precombustion or prechamber portion 22 that is formed within the cylinder head adjacent the main chamber portion. The main and prechamber portions of the combustion chamber are connected by a restricted passage 23 to provide for the passage of fluids between the two chamber portions.

Admission of air to the engine combustion chamber is provided for by an inlet port, not shown, extending through the cylinder head and opening into the main chamber portion, the opening being controlled in conventional fashion by an inlet poppet valve, also not shown.

Removal of spent combustion products from the combustion chamber is provided for by an exhaust port 24 that extends through the cylinder head from a side wall 26 to an opening 27 in the lower surface 20 of the cylinder head that communicates with the main combustion chamber portion 18. An exhaust poppet valve 28 normally closes the opening 27 and is actuated to an open position during the engine intake stroke by conventional means, such as rocker arm 30 and push rod 31 conventionally actuated by an engine driven camshaft. An optional auxiliary actuating device in the form of a solenoid 32 may also be provided to selectively actuate the exhaust valve 28 for purposes to be subsequently discussed.

The admission of fuel to the engine combustion chamber is conventionally provided for by an injection system including an injection nozzle 34 at each of the engine cylinders mounted in the cylinder head and arranged to deliver fuel to the interior of the prechamber portion 22. A glow plug 35 is also mounted at each cylinder location extending into the prechamber portion to aid the ignition of fuel-air mixtures formed therein.

To receive exhaust gases from the various cylinder combustion chambers of the engine, an exhaust manifold 36 is mounted on the side wall 26 of the cylinder head. Manifold 36 has a plurality of inlet openings 38 that connect with the various exhaust ports 24 of the engine. Openings 38 connect with a longitudinal plenum 39 bordered on one side by a baffle 40 that directs the incoming exhaust gas to one end of the manifold. There the gas is directed into the inlet 41 of a particulate trap portion 42 extending the length of the exhaust manifold on the other side of the baffle 40. Trap portion 42 contains a high temperature gas filtration material 43 suitable for separating and collecting particulates from the exhaust gas stream of the engine as the exhaust gases are directed through the filter material. At the end of the exhaust manifold particulate trap portion opposite the inlet, an outlet passage 44 is provided in an exhaust flange connection 46.

In accordance with the invention, the engine 10 is further provided with an auxiliary passage 47 in the cylinder head, extending from the combustion chamber prechamber portion 22 directly into the exhaust manifold inlet plenum 39. If desired, auxiliary passages may be provided at each of the cylinders but preferably only one passage will be required for each exhaust manifold of the engine. That passage is preferably located at the cylinder which is closest to the end of the baffle 40 at the inlet 41 where the plenum 39 is communicated with the particulate trap portion 42 of the exhaust manifold. Suitable means such as solenoid valve 48 are mounted in the cylinder head in a manner to selectively control the passage of gases through the auxiliary passage 47 through connection with a suitable source of electric power not shown.

In operation of an engine of the type described, air is drawn into each of the engine cylinders on the downward intake stroke of its piston when the inlet valve is open. On the subsequent piston upstroke, the air is compressed and some of it is forced through the restricted passage 23 into the prechamber portion 22 where fuel is injected and ignited by compression ignition near the top dead center position of the piston. During starting and engine warmup, ignition of the injected fuel may be aided by the glow plug 35.

Expansion of the burning gases in the prechamber portion forces a mixture of burning gas and air-fuel mixture through the restricted passage 23 into the main chamber portion where combustion continues. Further expansion of the gases forces the piston downwardly on the expansion stroke, resulting in an output of mechanical work. Upon the subsequent upstroke of the piston, caused by its connection with the engine crankshaft, not shown, the exhaust valve 28 is opened by the valve mechanism 30–31 and the spent exhaust gases are forced out through the exhaust port 24 into the exhaust manifold, passing from the inlet plenum 39 around the baffle 40 and through the filtration material 43 to the outlet passage 44.

As the engine continues in operation, a substantial volume of sooty, largely carbonaceous particulates will be collected within the filter material. In order to prevent the mass of material from becoming great enough to excessively restrict gas flow through the exhaust manifold, it is desirable to dispose of the collected particulates, which is advantageously accomplished by their incineration. This may be done by merely increasing the temperature of the collected particulates to their incineration temperature, since the excess air normally present in diesel engine exhaust gases is adequate to support combustion of the collected particulates once they have reached incineration temperature.

While the normal exhaust gas temperature of diesel engines is relatively high and may on occasion reach a point where spontaneous ignition and combustion of the collected exhaust particulates will take place, it is necessary to assure incineration at desired intervals to provide some means for increasing the engine exhaust gas temperature, or the temperature of the particulates themselves at the leading edge of the filtration material to the particulate ignition temperature. In the present invention, this is preferably accomplished by venting some of the burning mixture from at least one of the engine combustion chambers directly to the exhaust manifold during the high pressure combustion period in the associated combustion chamber.

In the described embodiment, this may be accomplished, for example, by actuating the solenoid valve 48 to open the auxiliary passage 47 shortly after the injection of fuel and the beginning of combustion in the prechamber portion 22. This will cause a high pressure mixture of burning gases, air and raw fuel to be forced through the passage 47 directly into the inlet plenum of the manifold preferably at a point near the inlet 41 where the hot burning mixture will be carried directly into the particulate trap portion 42 of the manifold. Upon reaching the filtration material, the burning or high temperature gases will rapidly increase the temperature of the particulates to their ignition point whereupon combustion of the particulates will ensue and spread throughout the filtration material, cleaning the filter of collected particulates. Operation of the valve 48 will preferably occur during a very short interval during the combustion period after which the valve will again be closed. It may again be operated during the following combustion periods if such intermittent operation is necessary to obtain the desired ignition temperature of the collected particulates. If necessary, auxiliary passages and control valves may be provided at more than one up to all of the engine cylinders.

Numerous alternative constructions may be provided for performing the method of the present invention. For example, an auxiliary passage could be provided in the cylinder head extending from the main combustion chamber portion of one of the cylinders directly to the exhaust manifold 36 and an auxiliary valve be provided to open this auxiliary passage during a portion of the combustion period in which burning gases are present in the main chamber portion. Alternatively, the main exhaust valve 28 for one or more of the cylinders could be momentarily actuated into an open position to conduct burning gases from the main combustion chamber portion through the exhaust port 24 to the exhaust manifold in order to provide the necessary heat for igniting collected particulates. Such a process could be accomplished by any suitable supplemental valve actuating mechanism or device such as, for example, the optionally included solenoid 32 shown in the drawing as available to selectively actuate the exhaust valve 28 to a partly open position.

It should be understood that the selective actuation of the main or auxiliary valve to direct burning gases into the exhaust manifold for igniting particulates will be required only occasionally during normal operation of the engine such as, for example, at predetermined intervals of engine operation or vehicle travel. Accordingly, the design of the valve devices utilized may be such as are suitable for an intermittent level of operation substantially less severe than the mechanisms required to operate continually during engine operation.

The filtration material used in the particulate trap portion of the exhaust manifold may be of any type capable of collecting a substantial volume of particulates and of resisting failure during the elevated temperatures reached during intermittent periods of incineration of particulates collected therein. Various materials for this purpose are available, examples of which are compacted high temperature wire mesh which may be coated with a catalytic agent, fibrous ceramic materials and monolithic ceramic filter structures.

While the invention has been disclosed by description of a preferred embodiment chosen for purposes of illustration, it should be understood that numerous additional changes could be made within the scope of the inventive concepts disclosed. Accordingly, it is intended that the invention not be limited to the described embodiments but that it have the full scope permitted by the language of the following claims.

The embodiments of the invention in which an exclusive property or privilege is claimed are defined as follows:

1. A process for limiting emissions of combustible particulates with the exhaust gases from a compression ignition engine of the type wherein excess air is present in the combustion chambers and exhaust gases, at least under conditions other than high load, and in which pressurized fuel-air mixtures are burned and the cylinder gases are expanded to a predetermined cylinder volume which develops substantial mechanical work prior to venting the cylinder gases to exhaust, said process comprising the steps of filtering the exhaust gases to collect combustible particulates in a filter capable of withstanding temperatures adequate to incinerate the collected particulates in the excess air containing exhaust gases, and occasionally, at extended intervals of engine operation, igniting and burning particulates collected in the filter by selectively venting burning pressurized mixture from at least one cylinder directly to said filter prior to the completion of burning and expansion in the cylinder to said predetermined volume, the mass of said burning mixture which is selectively vented being sufficient to raise to their combustion temperature the particulates in at least a selected portion of said filter, whereby there results ignition and burning of the collected particulates supported by the excess air containing engine exhaust gases passed through the filter.

2. A diesel engine having means defining a closed end cylinder, a piston reciprocable in the cylinder and defining therewith a variable volume combustion chamber at the cylinder closed end in which combustion of pressurized mixtures is performed during cyclical combustion periods that begin periods of work-produced expansion through reciprocation of the piston away from the cylinder closed end, an exhaust port through the cylinder defining means and communicating the combustion chamber with an exterior location to conduct fluids from the combustion chamber, an exhaust particulate trap connected with the cylinder defining means and communicating with the exhaust port to receive exhaust gases therefrom, said trap defining a flow path for exhausted fluids, filter means in the fluid flow path for collecting particulates from spent engine exhaust gases passed therethrough, means including a poppet valve in the exhaust port normally operative to close said port during the combustion and expansion periods and to open said port during subsequent exhaust periods to permit the passage of spent combustion products from the combustion chamber through the particulate trip to atmosphere, and supplemental means selectively operative at extended intervals of engine operation to occasionally communicate the combustion chamber with the particulate trap during selected combustion periods so as to conduct some of the burning combustion chamber mixture to the trap for igniting and burning the collected particulates therein.

3. A diesel engine in accordance with claim 2 wherein said supplemental means comprises means to occasionally selectively operate said exhaust valve to open said exhaust valve port during portions of selected ones of said combustion periods whereby burning combustion chamber mixture is directed through said exhaust port to the particulate trap.

4. A diesel engine having means defining a closed end cylinder, a piston reciprocable in the cylinder and defining therewith a variable volume combustion chamber at the cylinder closed end in which combustion of pressurized mixtures is performed during cyclical combustion periods that begin periods of work-produced expansion through reciprocation of the piston away from the cylinder closed end, an exhaust port through the cylinder defining means and communicating the combustion chamber with an exterior location to conduct fluids from the combustion chamber, an exhaust particulate trap connected with the cylinder defining means and communicating with the exhaust port to receive exhaust gases therefrom, said trap defining a flow path for exhausted fluids, filter means in the fluid flow path for collecting particulates from spent engine exhaust gases passed therethrough, means including a poppet valve in the exhaust port normally operative to close said port during the combustion and expansion periods and to open said port during subsequent exhaust periods to permit the passage of spent combustion products from the combustion chamber through the particulate trap to atmosphere, and supplemental means selectively operative at extended intervals of engine operation to occasionally communicate the combustion chamber with the particulate trap during selected combustion periods so as to conduct some of the burning combustion chamber mixture to the trap for igniting and burning the collected particulates therein, said supplemental means comprising an auxiliary passage through said cylinder defining means and communicating said combustion chamber with the particulate trap and supplemental valve means in said auxiliary passage and operative to selectively open said auxiliary passage during portions of selected ones of said combustion periods whereby burning combustion chamber mixture is conducted to said exhaust trap.

5. A diesel engine in accordance with claim 4 wherein said combustion chamber is divided into main and prechamber portions separated by a restricted passage and formation and initial combustion of the pressurized mixtures occurs in said prechamber portion and wherein said auxiliary passage through said cylinder defining means communicates said prechamber portion with said particulate trap, said supplemental valve means normally closing said auxiliary passage and being selectively operative to open said auxiliary passage during part of selected ones of said combustion periods to conduct burning combustion chamber mixture to the particulate trap.

* * * * *